US005911310A

United States Patent [19]

Bridgers

[11] Patent Number: 5,911,310

[45] Date of Patent: Jun. 15, 1999

[54] INFLATABLE SHIN GUARD

[76] Inventor: Leo W. Bridgers, 427 Canyon St., Spearfish, S. Dak. 57783

[21] Appl. No.: 09/065,208

[22] Filed: Apr. 23, 1998

[51] Int. Cl.[6] ..... A41D 13/06

[52] U.S. Cl. ..... 2/22; 2/911; 2/DIG. 3

[58] Field of Search ..... 2/22, 23, 24, 20, 2/16, 19, 161.1, 911, 455, DIG. 3

[56] References Cited

U.S. PATENT DOCUMENTS

| | | | |
|---|---|---|---|
| 871,760 | 11/1907 | Long | 2/24 |
| 1,726,939 | 9/1929 | Anderson | 2/22 |
| 3,135,964 | 6/1964 | Pender | 2/22 |
| 3,784,985 | 1/1974 | Conroy | 2/22 |
| 4,001,953 | 1/1977 | Fugere | 2/22 |
| 4,370,754 | 2/1983 | Donzis | 2/2 |
| 5,405,312 | 4/1995 | Jacobs | 602/5 |
| 5,551,084 | 9/1996 | Freese | 2/23 |
| 5,634,211 | 6/1997 | Chen | 2/22 |

*Primary Examiner*—John J. Calvert
*Assistant Examiner*—Tejash D Patel

[57] ABSTRACT

A inflatable shin guard for providing air cushioned padding to a shin guard. The inventive device includes a shell member having a front and a back and adapted to conform to the shin of a user. The back of the shell member has a recess. An inflatable bladder member is provided in the recess of the back of the shell member. The bladder member is adapted to substantially fill the recess when inflated.

9 Claims, 1 Drawing Sheet

INFLATABLE SHIN GUARD

BACKGROUND OF THE INVENTION

1. Field of the Invention

The present invention relates to shin guards and more particularly pertains to a new inflatable shin guard for providing air cushioned padding to a shin guard.

2. Description of the Prior Art

The use of shin guards is known in the prior art. More specifically, shin guards heretofore devised and utilized are known to consist basically of familiar, expected and obvious structural configurations, notwithstanding the myriad of designs encompassed by the crowded prior art which have been developed for the fulfillment of countless objectives and requirements.

Known prior art shin guards include U.S. Pat. No. 4,999,847; U.S. Pat. No. 4,633,529; U.S. Pat. No. 4,627,108; U.S. Pat. No. 4,306,315; U.S. Pat. No. 4,067,063; and U.S. Pat. No. Des. 362,087.

While these devices fulfill their respective, particular objectives and requirements, the aforementioned patents do not disclose a new inflatable shin guard. The inventive device includes a shell member having a front and a back and adapted to conform to the shin of a user. The back of the shell member has a recess. An inflatable bladder member is provided in the recess of the back of the shell member. The bladder member is adapted to substantially fill the recess when inflated.

In these respects, the inflatable shin guard according to the present invention substantially departs from the conventional concepts and designs of the prior art, and in so doing provides an apparatus primarily developed for the purpose of providing air cushioned padding to a shin guard.

SUMMARY OF THE INVENTION

In view of the foregoing disadvantages inherent in the known types of shin guards now present in the prior art, the present invention provides a new inflatable shin guard construction wherein the same can be utilized for providing air cushioned padding to a shin guard.

The general purpose of the present invention, which will be described subsequently in greater detail, is to provide a new inflatable shin guard apparatus and method which has many of the advantages of the shin guards mentioned heretofore and many novel features that result in a new inflatable shin guard which is not anticipated, rendered obvious, suggested, or even implied by any of the prior art shin guards, either alone or in any combination thereof.

To attain this, the present invention generally comprises a shell member having a front and a back and adapted to conform to the shin of a user. The back of the shell member has a recess. An inflatable bladder member is provided in the recess of the back of the shell member. The bladder member is adapted to substantially fill the recess when inflated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inflatable shin guard apparatus and method which has many of the advantages of the shin guards mentioned heretofore and many novel features that result in a new inflatable shin guard which is not anticipated, rendered obvious, suggested, or even implied by any of the prior art shin guards, either alone or in any combination thereof.

It is another object of the present invention to provide a new inflatable shin guard which may be easily and efficiently manufactured and marketed.

It is a further object of the present invention to provide a new inflatable shin guard which is of a durable and reliable construction.

An even further object of the present invention is to provide a new inflatable shin guard which is susceptible of a low cost of manufacture with regard to both materials and labor, and which accordingly is then susceptible of low prices of sale to the consuming public, thereby making such inflatable shin guard economically available to the buying public.

Still yet another object of the present invention is to provide a new inflatable shin guard which provides in the apparatuses and methods of the prior art some of the advantages thereof, while simultaneously overcoming some of the disadvantages normally associated therewith.

Still another object of the present invention is to provide a new inflatable shin guard for providing air cushioned padding to a shin guard.

Yet another object of the present invention is to provide a new inflatable shin guard which includes a shell member having a front and a back and adapted to conform to the shin of a user. The back of the shell member has a recess. An inflatable bladder member is provided in the recess of the back of the shell member. The bladder member is adapted to substantially fill the recess when inflated.

Still yet another object of the present invention is to provide a new inflatable shin guard that protects a user's shins better than conventional shin guards.

Even still another object of the present invention is to provide a new inflatable shin guard that helps reduce the effect of an impact to a user's shin when the shin guard is struck or kicked.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
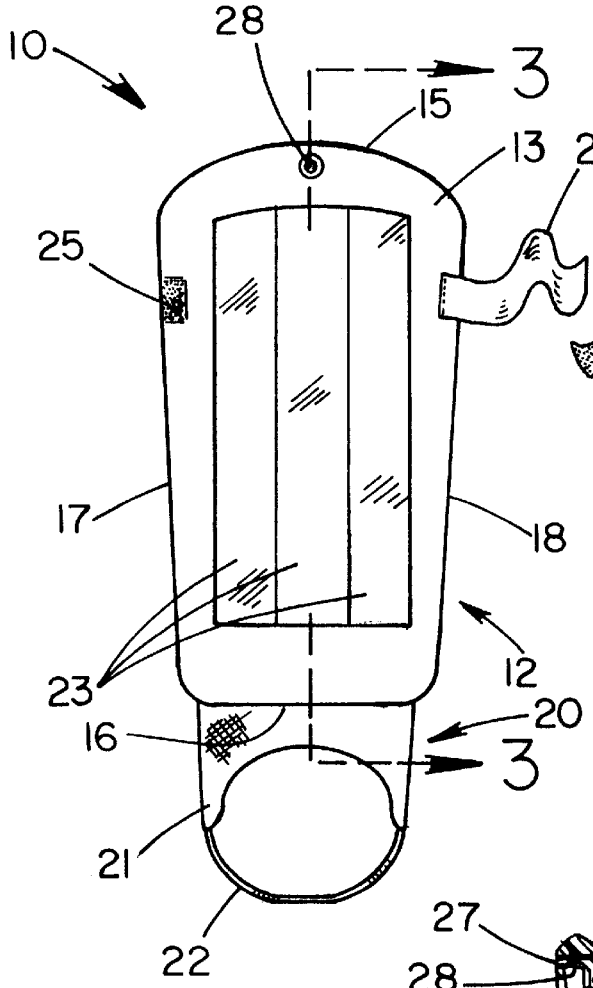
FIG. 1 is a schematic front side view of a new inflatable shin guard according to the present invention.
Figure 2:
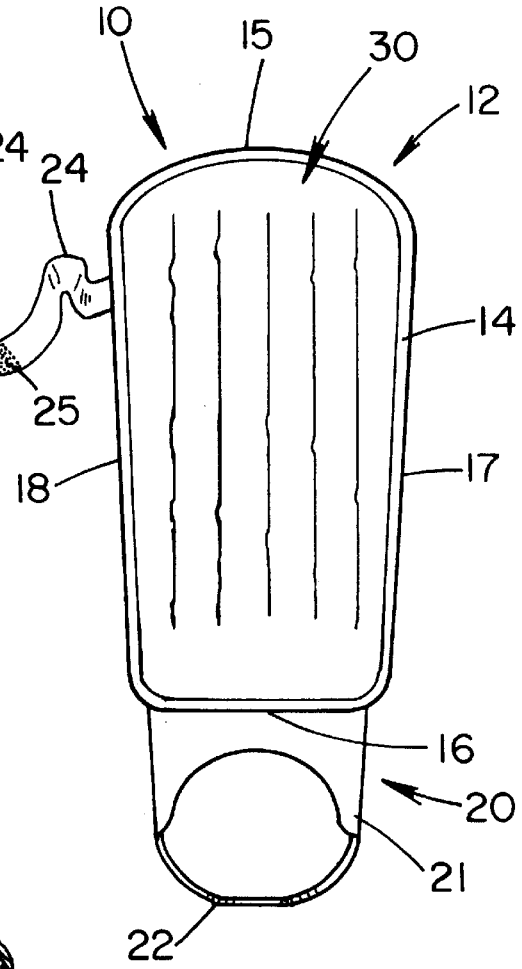
FIG. 2 is a schematic back side view of the present invention.
Figure 3:
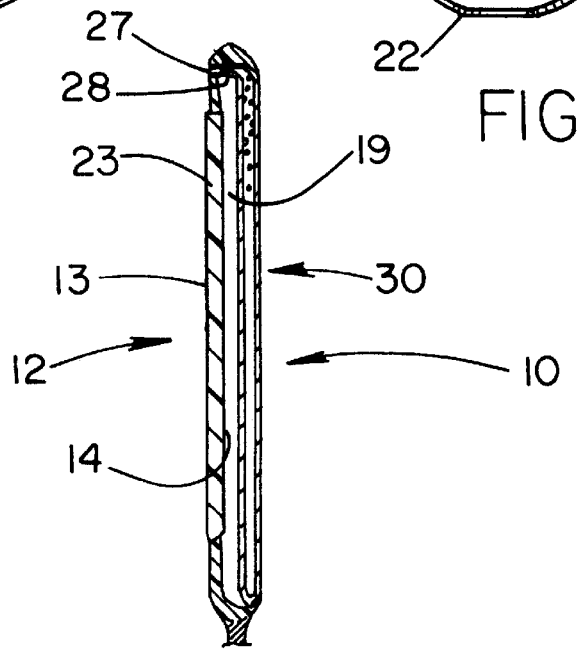
FIG. 3 is a schematic cross sectional view of the present invention taken from line 3—3 on FIG. 1.

With reference now to the drawings, and in particular to FIGS. 1 through 3 thereof, a new inflatable shin guard embodying the principles and concepts of the present invention and generally designated by the reference numeral 10 will be described.

As best illustrated in FIGS. 1 through 3, the inflatable shin guard 10 generally comprises a shell member 12 having a front 13 and a back 14 and adapted to conform to the shin of a user. The back 14 of the shell member 12 has a recess 19. An inflatable bladder member 30 is provided in the recess 19 of the back 14 of the shell member 12. The bladder member 30 is adapted to substantially fill the recess 19 when inflated.

In closer detail, the shell member 12 has a front 13, a back 14, a pair of opposite ends 15,16, and a pair of sides 17,18 extending between the ends 15,16. The shell member 12 is adapted to conform to the shin of a user. Ideally, the shell member 12 comprises a generally rigid resilient plastic. In an illustrative ideal example, the shell member 12 has a length between its ends 15,16 of less than about 10 inches and a width between its sides 17,18 of less than about 4 inches. The back 14 of the shell member 12 has a perimeter lip which defines a recess 19. The front 13 of the shell member 12 preferably includes a plurality of generally rectangular reinforcing strips 23 centrally positioned thereon. The reinforcing strips 23 are designed for providing additional resilient protection to the front 13 of the shell member 12. In the ideal embodiment, one of the ends 15 of the shell member 12 is arcuate in shape.

A foot strap 20 member is coupled to the other end 16 of the shell member 12. The foot strap 20 preferably comprises a flexible material upper portion 21 and an instep strap portion 22. The foot strap 20 is adapted for receiving a foot between the upper portion 21 and the instep strap portion 22.

A flexible leg strap 24 having a pair of opposite ends is also included and is adapted from looping around the back 14 of a user's shin to secure the shin guard 10 to the shin of the user. One of the ends of the leg strap 24 is coupled to the shell member 12 at one of the sides 18 of the shell member 12 while the other end of the leg strap 24 is detachably attached to the shell member 12 at the other side 17 of the shell member 12. Ideally, a hook and loop fastener 25 detachably attaches the other end of the leg strap 24 to the shell member 12 at the other side 17 of the shell member 12.

The inflatable bladder member 30 is provided in the recess 19 of the back 14 of the shell member 12. The bladder member 30 may also be optionally coupled to the shell member 12. The interior of the bladder member 30 may be filled with pumped air or carbon dioxide such as from a carbon dioxide cartridge. Ideally, the bladder member 30 is adapted to substantially fill the recess 19 when the bladder member 30 is inflated. The bladder member 30 is designed for providing padding to the shin guard 10. Preferably, the shell member 12 has an opening 27 into the interior of the bladder member 30. The opening 27 is extended through the front 13 and back 14 of the shell member 12 and preferably positioned towards the one of the ends 15 of the shell member 12. The opening 27 permits the passage of air through for inflating and deflating the bladder member 30. In the preferred embodiment, a valve 28 selectively closes the opening 27. In an ideal optional embodiment, the valve 28 may include an air pump such as the type found on pump style athletic shoes for passing air into the interior of the bladder member 30.

In use, the shin guard is attached to a shin with the leg strap and the foot strap. The bladder member is filled with air of carbon dioxide to inflate it so that it fills the recess of the shell member to provide an air cushioned pad to the shin guard.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shin guard, comprising:

a shell member having a front, a back, a pair of opposite ends, and a pair of sides extending between said ends of said shell member, said shell member being adapted to conform to the shin of a user;

said back of said shell member having a recess defined by a peripheral lip coupled to a periphery of said back of said shell member and extending rearwardly therefrom;

an inflatable bladder member being provided in said recess of said back of said shell member, wherein said bladder member is adapted to substantially fill said recess when inflated;

said shell member having a conduit in communication with an interior of said bladder member, said conduit being extended between said front and back of said shell member in perpendicular relationship with a plane in which said bladder member resides, said conduit being positioned at one of said ends of said shell member, said conduit permitting passage of air therethrough for inflating and deflating said bladder member; and a valve for selectively closing said conduit, wherein said valve includes an air pump mounted on said front of said shell member for passing air into said interior of said bladder member.

2. The shin guard of claim 1, wherein said shell member comprises plastic.

3. The shin guard of claim 1, wherein said front of said shell member includes a plurality of reinforcing strips thereon.

4. The shin guard of claim 1, wherein one of said ends of said shell member is arcuate in shape.

5. The shin guard of claim 1, further comprising a foot strap being coupled to another of said ends of said shell member.

6. The shin guard of claim 5, wherein said foot strap comprises a flexible upper portion and an instep strap portion, said foot strap being adapted for receiving a foot between said upper portion and said instep strap portion.

7. The shin guard of claim 1, further comprising a flexible leg strap having a pair of opposite ends, one of said ends of said leg strap being coupled to said shell member at one of said sides of said shell member, another of said ends of said leg strap being detachably attached to said shell member at another of said sides of said shell member.

8. The shin guard of claim 7, wherein a hook and loop fastener detachably attaches said another end of said leg strap to said shell member at said another side of said shell member.

9. A shin guard, comprising:

a shell member having a front, a back, a pair of opposite ends, and a pair of sides extending between said ends of said shell member, said shell member being adapted to conform to the shin of a user;

wherein said shell member comprises resilient plastic, wherein said shell member has a length between its ends of less than about 10 inches and a width between its sides of less than about 4 inches;

said back of said shell member having a recess therein defined by a peripheral lip coupled to a periphery of said back of said shell member and extending rearwardly therefrom;

said front of said shell member including a plurality of vertically oriented generally rectangular reinforcing strips thereon, said reinforcing strips being for providing additional resilient protection to said front of said shell member;

one of said ends of said shell member being arcuate in shape;

a foot strap being coupled to another of said ends of said shell member, said foot strap comprising a flexible upper portion and an instep strap portion, said foot strap being adapted for receiving a foot between said upper portion and said instep strap portion;

a flexible leg strap having a pair of opposite ends, said leg strap being adapted for looping around a back of a user's shin to secure said shin guard to the shin of the user, one of said ends of said leg strap being coupled to said shell member at one of said sides of said shell member, another of said ends of said leg strap being detachably attached to said shell member at another of said sides of said shell member, wherein a hook and loop fastener detachably attaches said another end of said leg strap to said shell member at said another side of said shell member;

an inflatable bladder member being provided in said recess of said back of said shell member, said bladder member being coupled to said shell member, wherein an interior of said bladder member may be filled with pumped air, wherein said bladder member is adapted to substantially fill said recess when said bladder member is inflated, said bladder member being for providing padding to said shin guard;

said shell member having a conduit in communication with said interior of said bladder member, said conduit being extended between said front and back of said shell member in perpendicular relationship with a plane in which said bladder member resides, said conduit being positioned towards said one of said ends of said shell member, said conduit permitting passage of air therethrough for inflating and deflating said bladder member; and a valve for selectively closing said conduit, wherein said valve includes an air pump mounted on said front of said shell member for passing air into said interior of said bladder member.

* * * * *